US008950636B2

(12) United States Patent
Landman

(10) Patent No.: US 8,950,636 B2
(45) Date of Patent: Feb. 10, 2015

(54) DEVICE FOR HOLDING BEVERAGE

(75) Inventor: Bernardus Cornelis Johannes Landman, Boskoop (NL)

(73) Assignee: Heineken Supply Chain B.V., Amsterdam (NL)

( * ) Notice: Subject to any disclaimer, the term of this patent is extended or adjusted under 35 U.S.C. 154(b) by 232 days.

(21) Appl. No.: 12/936,860

(22) PCT Filed: Apr. 8, 2009

(86) PCT No.: PCT/NL2009/050185

§ 371 (c)(1),
(2), (4) Date: Oct. 27, 2010

(87) PCT Pub. No.: WO2009/126035

PCT Pub. Date: Oct. 15, 2009

(65) Prior Publication Data

US 2011/0036807 A1 Feb. 17, 2011

(30) Foreign Application Priority Data

Apr. 10, 2008 (NL) ..... 2001467

(51) Int. Cl.
*B65D 83/00* (2006.01)
*B67D 1/08* (2006.01)

(52) U.S. Cl.
CPC ..... *B67D 1/0801* (2013.01); *B67D 1/0805* (2013.01)
USPC ..... 222/399; 222/1; 222/394; 222/396; 222/402.1

(58) Field of Classification Search
USPC ..... 222/1, 399, 394, 396, 402.1
See application file for complete search history.

(56) References Cited

U.S. PATENT DOCUMENTS

| | | | | | |
|---|---|---|---|---|---|
| 2,547,052 | A | * | 4/1951 | Sollman | 141/17 |
| 3,245,435 | A | * | 4/1966 | Healy | 141/3 |
| 3,613,954 | A | * | 10/1971 | Bayne | 222/61 |
| 3,632,023 | A | | 1/1972 | Johnston | |
| 3,815,798 | A | * | 6/1974 | Lavitch et al. | 223/102 |
| 3,876,221 | A | * | 4/1975 | Bryntse | 280/43.12 |
| 3,964,649 | A | * | 6/1976 | Alexander | 222/399 |
| 4,121,772 | A | | 10/1978 | Cronan | |
| 4,147,283 | A | * | 4/1979 | Mascia et al. | 222/399 |
| 4,174,811 | A | * | 11/1979 | Binder et al. | 239/308 |
| 4,310,108 | A | * | 1/1982 | Motoyama et al. | 222/396 |
| 4,402,429 | A | * | 9/1983 | Vanden Driessche | 222/153.01 |
| 4,595,127 | A | * | 6/1986 | Stoody | 222/135 |
| 4,632,276 | A | * | 12/1986 | Makino | 222/80 |
| 5,110,012 | A | * | 5/1992 | Scholle et al. | 222/83.5 |
| 5,246,140 | A | * | 9/1993 | Thix et al. | 222/4 |

(Continued)

FOREIGN PATENT DOCUMENTS

| | | |
|---|---|---|
| EP | 1064221 | 1/2001 |
| EP | 1140658 A1 | 10/2001 |

(Continued)

*Primary Examiner* — Frederick C Nicolas
(74) *Attorney, Agent, or Firm* — Pearne & Gordon LLP

(57) ABSTRACT

Holder for beverage, including a container manufactured substantially from plastic, provided with a neck, wherein in an inner space of the container liquid is provided and on or in the neck a valve is provided, through which valve extends a dispensing apparatus, wherein the valve is fixed in or to the neck and wherein a pressure device is provided for pressurizing the liquid in the container, wherein in or on the neck an element is suspended which at least partly extends in the inner space of the container and at least partly surrounds the dispensing apparatus.

33 Claims, 17 Drawing Sheets

(56) References Cited

U.S. PATENT DOCUMENTS

| | | | | |
|---|---|---|---|---|
| 5,368,207 | A | 11/1994 | Cruysberghs | |
| 6,360,923 | B1 | 3/2002 | Vlooswijk | |
| 6,386,403 | B2 * | 5/2002 | Parsons et al. | 222/399 |
| 6,415,963 | B1 | 7/2002 | Vlooswijk et al. | |
| 6,708,844 | B2 * | 3/2004 | Lim et al. | 222/3 |
| 6,745,922 | B1 | 6/2004 | Vlooswijk et al. | |
| 6,942,127 | B2 | 9/2005 | Raats | |
| 8,070,023 | B2 * | 12/2011 | Vitantonio et al. | 222/399 |
| 2005/0045662 | A1 | 3/2005 | Raats | |
| 2005/0269359 | A1 | 12/2005 | Raats | |
| 2007/0114249 | A1 | 5/2007 | Schneider et al. | |
| 2008/0099511 | A1 | 5/2008 | Schneider et al. | |
| 2009/0302069 | A1 | 12/2009 | Oberhofer et al. | |
| 2010/0084435 | A1 * | 4/2010 | Paauwe et al. | 222/399 |

FOREIGN PATENT DOCUMENTS

| | | | |
|---|---|---|---|
| EP | 1140692 | B1 | 10/2001 |
| EP | 1642861 | A1 | 4/2006 |
| NL | 1008601 | | 4/2004 |
| WO | 8801981 | A | 3/1988 |
| WO | 95/11855 | A1 | 5/1995 |
| WO | 03050031 | A | 6/2003 |
| WO | 2005095229 | A1 | 10/2005 |
| WO | 2007/108683 | A1 | 9/2007 |
| WO | 2008048098 | A1 | 4/2008 |

* cited by examiner

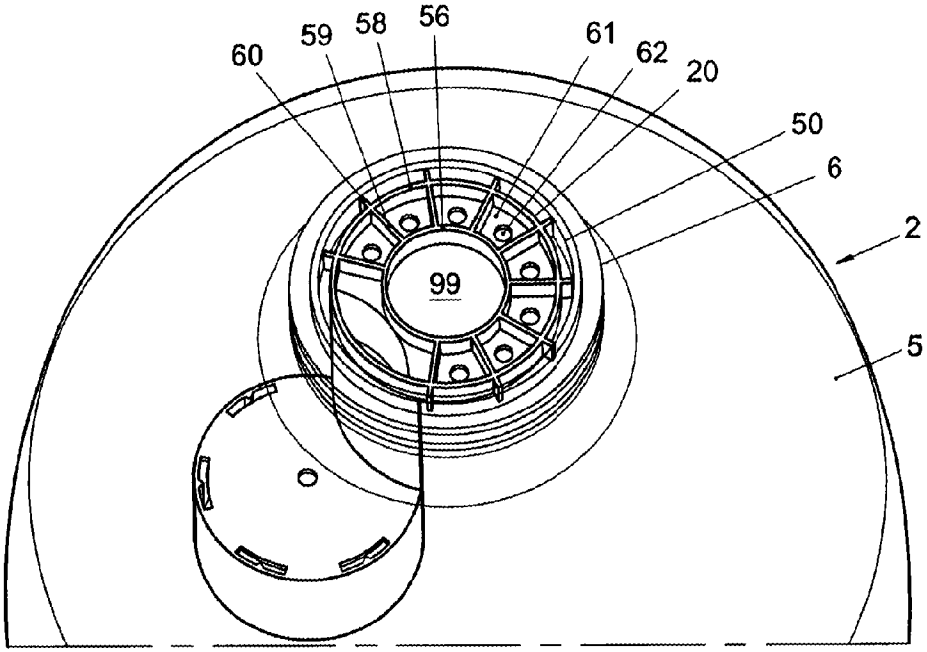
FIG. 11A
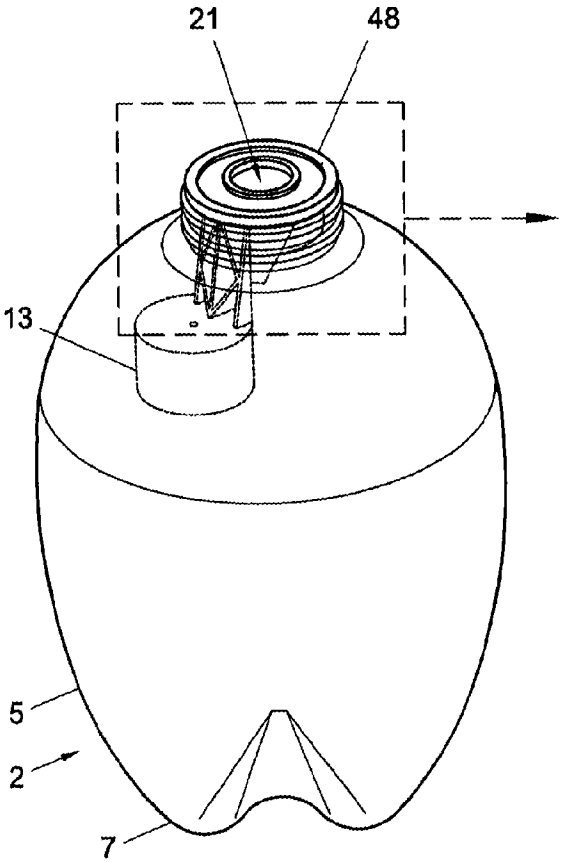

DEVICE FOR HOLDING BEVERAGE

FIELD OF THE INVENTION

The invention relates to a device for storing beverage.

BACKGROUND OF THE INVENTION

Beverage such as carbonated beverage, for instance soft drink or beer, can be offered in, for instance, bottles, cans or kegs. When the beverage is packaged in a plastic bottle, usually a blown plastic bottle is used, having a neck which is closed off by a screw cap. For pouring out the beverage, the cap is unscrewed, whereupon a part of the beverage can be poured out and the cap can be screwed back onto the neck again.

When beverage is packaged in a can or keg, usually an external pressure source is used, such as for instance a gas cylinder and dosing device for regulating pressure in the can or keg. The beverage is then dispensed under pressure via a tapping device configured for that purpose.

From EP 1064221 a device is known where in a plastic or metal container a pressure regulator is provided, which is for instance glued onto the bottom of the container or suspended from the cover.

An object of the invention is to provide a holder for beverage which is simple in structure and use. Another object of the invention is to provide a holder for beverage with which beverage can be dispensed under pressure. A further object of the invention is to provide a holder for beverage in which the beverage is protected from outside influences, such as contamination. These and/or other objects can be achieved with a holder or method according to the invention.

SUMMARY OF THE INVENTION

In a first aspect, a holder according to the specification comprises a container manufactured substantially from plastic, provided with a neck, wherein in an inner space of the container liquid is provided and on or in the neck a valve is provided. Through the valve extends a dispensing means. The valve is fixed in or to the neck and a pressure device is provided for pressurizing the liquid in the container. In or on the neck an element is suspended which at least partly extends in the inner space of the container and at least partly surrounds the dispensing means.

In another aspect, a method is described for the formation of a holder. Into a container with a neck, liquid is introduced through the neck, with the neck being at least partly closed off by a valve. A dispensing device is inserted in the inner space of the container and an element is suspended from or in the neck in an inner space of the container. The element at least partly surrounds the dispensing device, such that the beverage can be dispensed from the container only through the dispensing device.

BRIEF DESCRIPTION OF THE DRAWINGS

In clarification of the invention, embodiments of a holder or dispensing device and parts thereof and methods will be further elucidated with reference to the drawing. In the drawing.

DETAILED DESCRIPTION OF PREFERRED EMBODIMENTS OF THE INVENTION

Figure 1:
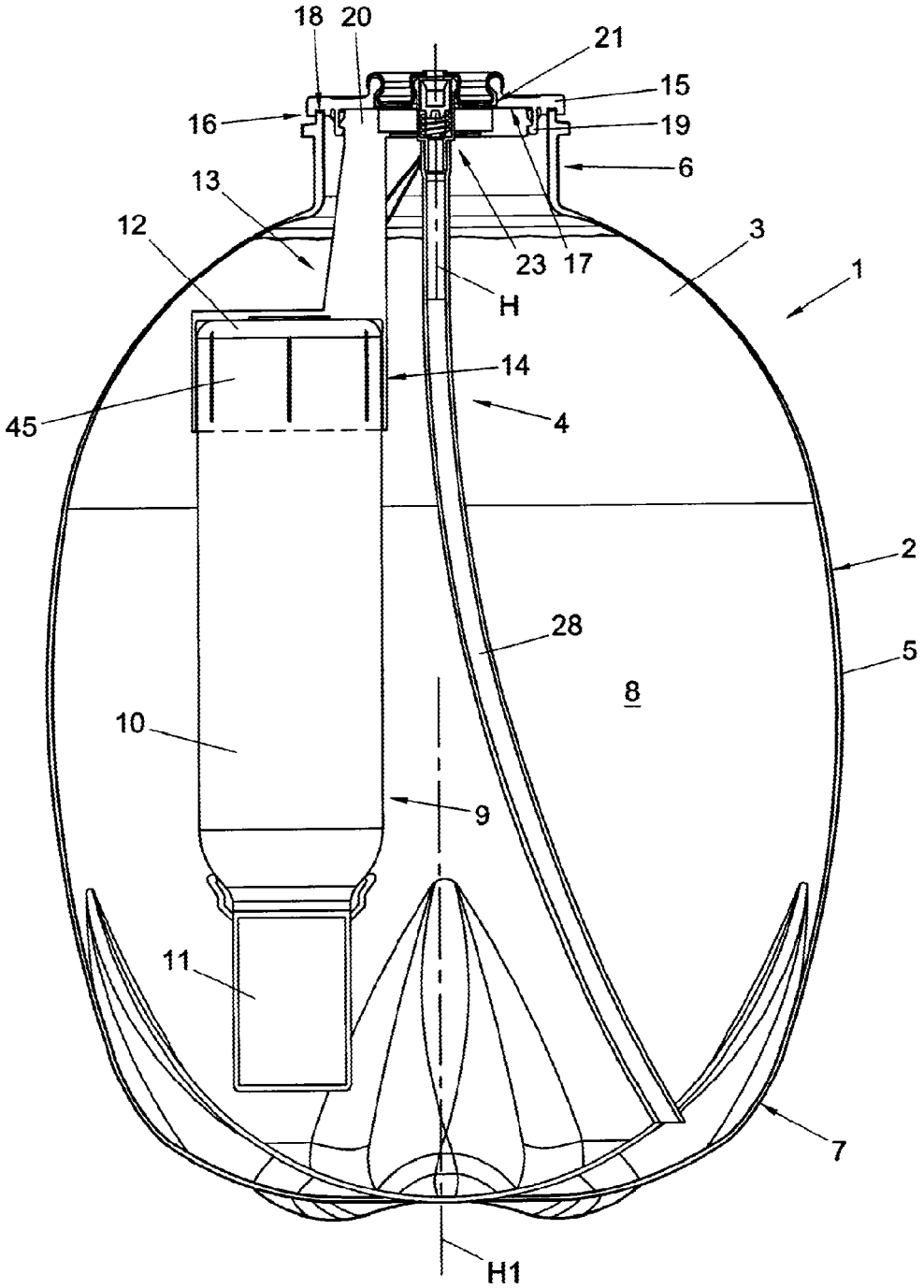
FIG. 1 shows in partly sectional side elevation a first embodiment of a holder.

In this description the same or corresponding parts have the same or corresponding reference numerals. The embodiments shown are shown only by way of illustration and should not be construed in any way as limiting. In this description, examples will be discussed and shown for dispensing beer, in particular lager-type beer. However, also other types of beverage can be dispensed from a device according to the specification. In this description the designation "lower" designates a side of a holder which is represented at the bottom in the figures. The designation "upper" is accordingly to be understood as being the opposite side.

In this description, there is described inter glia an element which can be wholly or partly inserted, suspended and/or supported or otherwise locked or arranged in a holder. In embodiments, this internal element can comprise a pressure regulating device. In other embodiments, the element can comprise an inner bottle, inner jacket, bag, widget or the like. Many variations of other elements that can be arranged in a holder are possible and understood to be disclosed herein.

Figure 14:
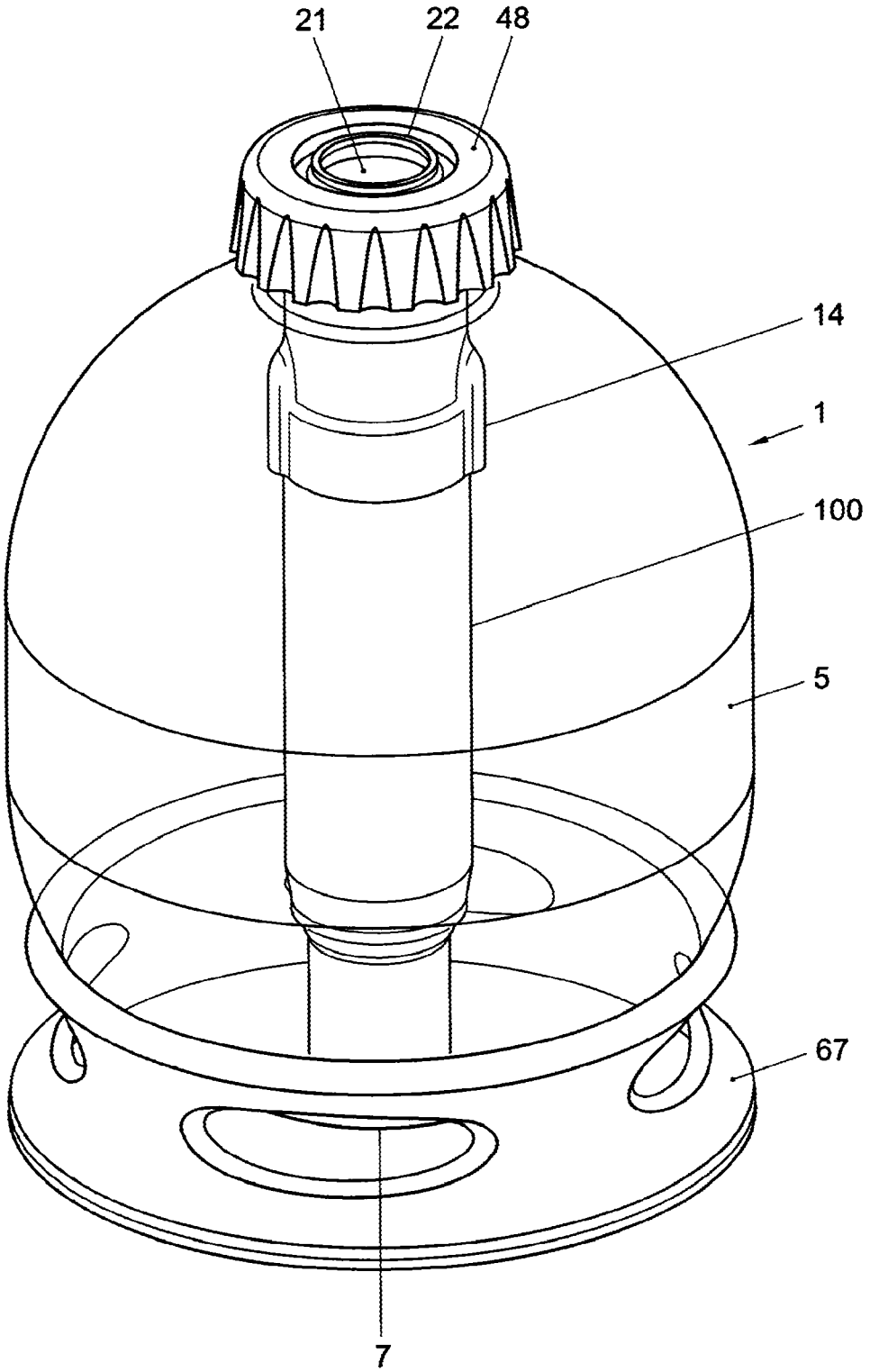
FIG. 14 shows a holder in a partly translucent embodiment, with a stand ring arranged adjacent a bottom.

FIG. 1 shows schematically and in partly sectional side elevation a holder 1, comprising a container 2, for instance wholly or partly filled with beverage 3, and a dispensing device 4. The beverage 3 can be beer. In an embodiment, the container 2 may be formed as a blown plastic bottle. In another embodiment, the container 2 may be rotation molded, injection molded or otherwise manufactured wholly or partly from plastic. The container may also be wholly or partly manufactured from a different material, as metal. The container 2 is provided with a body 5, a neck 6 and a bottom 7. The bottom 7 may for instance be a "petal" bottom having for instance three, four or five supporting feet. In this way, a self-standing bottle can be obtained, which can moreover be resistant to relatively high internal pressures, for instance five bars or more. In another embodiment, the bottle may for instance be provided with a stand ring, as schematically shown in FIG. 14, on which the bottle can stand. This ring may for instance be formed-on, glued-on, clamped-on, integrally injection molded or provided otherwise and can be used in any embodiment of a holder according to the application. The body 5 may be global so as to be able to resist internal pressure in a simple manner. However, it can also have a different shape. The body 5, the bottom 7 and the neck 6 substantially define an inner space 8, in which the beverage 3 is received. In the inner space 8 extends, in this embodiment, substantially the dispensing device 4.

Figure 2:
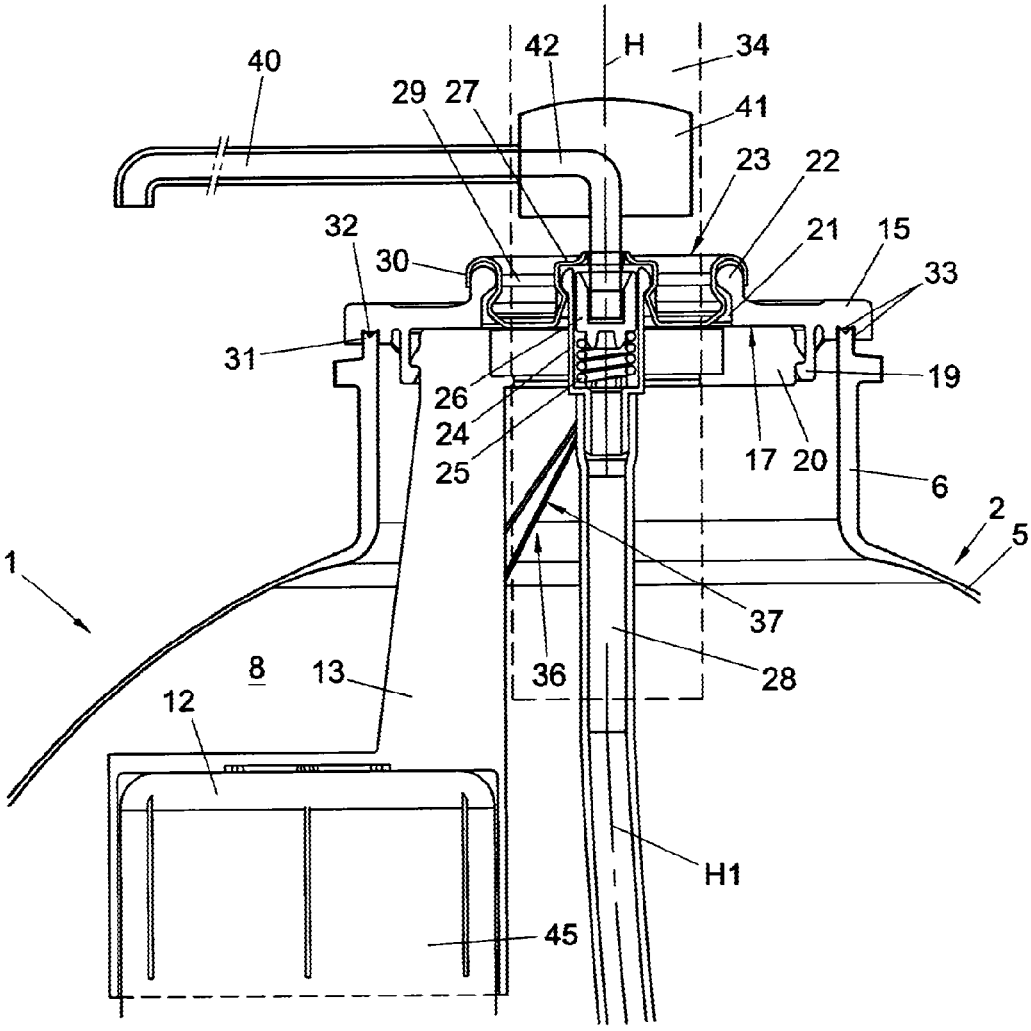
FIG. 2 shows in magnification a portion of a holder according to FIG. 1, with a schematically represented dispensing tube.
Figure 3:
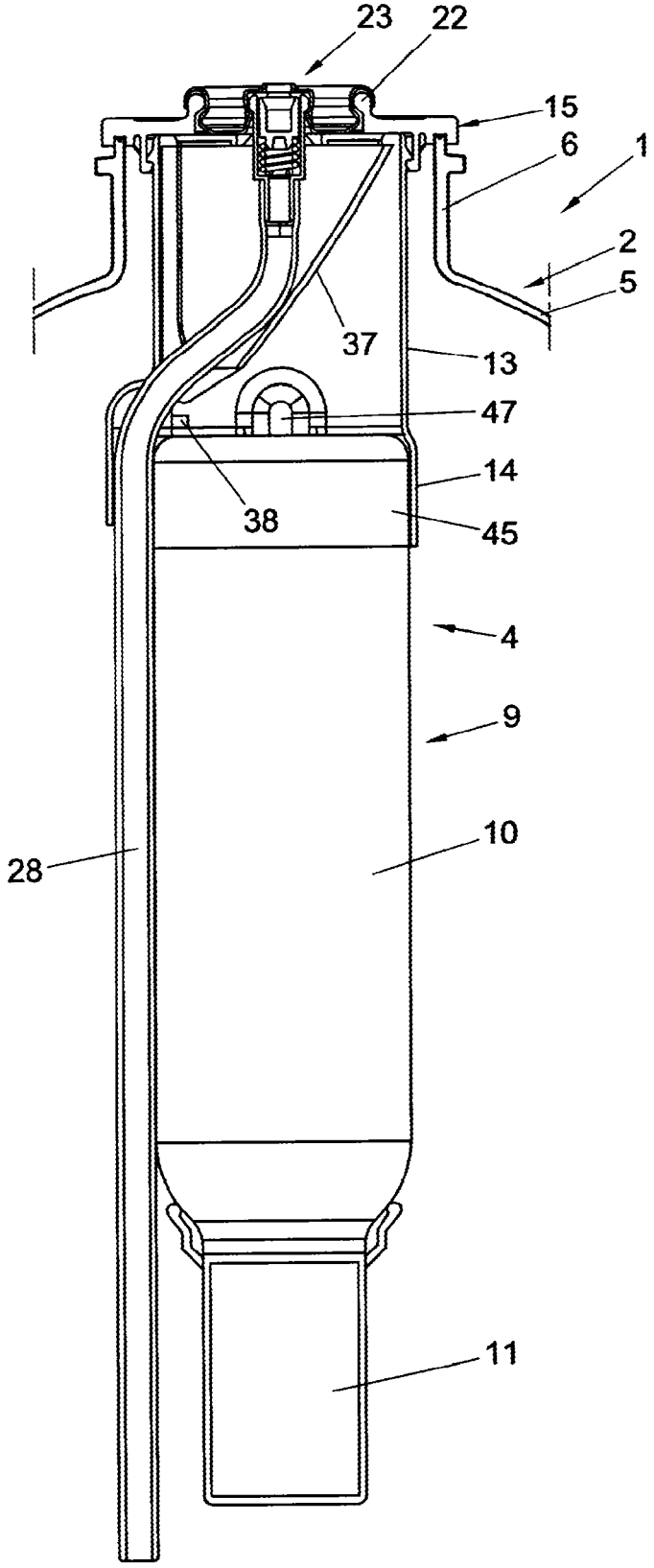
FIG. 3 shows in partly sectional side elevation a second embodiment of a holder.

The dispensing device 4 in this embodiment comprises for instance a device as known from NL 1008601, for instance as shown in FIGS. 1 to 3 thereof. Other examples of possible embodiments of dispensing devices 4 and/or pressure devices 9 to be used therein are for instance known from EP 1 140 658, WO 2005/095229, EP 1 642 861, U.S. Pat. No. 5,368,207 or from the non-prepublished patent applications of applicant, titled "Pressure regulator and tapping apparatus provided therewith" or "Tapping apparatus, provided with a pressure regulating device", filed on Mar. 31, 2008. These devices 4, 9 are mentioned only by way of illustration, should not be construed in any way as limiting, and are all configured, on the basis of the internal pressure in the inner space 8 and/or through operation by a user, to regulate the pressure in the inner space 8 through introduction of gas under pressure from a storage reservoir 10 into the inner space 8, controlled by a pressure regulating device 11.

A pressure device 9 in the embodiment shown comprises an aerosol container 10 as a storage reservoir, closed off by an aerosol valve (not shown). A pressure-controlled regulating unit 11 as a pressure regulating device is fixed on the aerosol container 10, such that the aerosol valve can be opened by the regulating unit 11 if the pressure in the inner space 8 falls below a desired pressure. Preferably, as a result, the pressure device 9 operatively regulates the pressure in the inner space to an equilibrium pressure of $CO_2$ in the beverage, at a desired temperature, for instance a pressure between approximately 1.2 and 2 bar absolute, more particularly between approximately 1.4 and 1.6 bar between for instance 0 and 15° C., for instance at approximately 6° C. For instance for beverages other than beer, of course, in each case a suitable pressure can be set.

In the embodiment shown in FIG. 1, the pressure device 9 with the container 10, which may for instance be manufactured from metal, is suspended by a bottom 12 from the side of the neck 6. The regulating unit 11 in the position shown in FIG. 1 is hence directed downwards, facing towards the bottom 7. It will be clear, however, that the actual position during use naturally also depends on the orientation of the holder L In FIG. 1 the latter is set up on the bottom 7. The pressure device 9 is suspended in a bracket 13, for instance manufactured from plastic, which bracket 13 comprises a clamping ring 14 which can clampingly embrace a part 45 of the container 10 contiguous to the bottom 12. In another embodiment, the container 10 or pressure device 9 as such may be fixed to the bracket 13 in a different manner, for instance by gluing, by cooperating clamping means on the bracket 13 and/or the container 10 and/or the regulating unit 11.

On the side of the neck 6 the bracket 13 is attached to or provided with a suspension ring 15. In an embodiment, the suspension ring 15 is substantially disc-shaped and rests by an edge 16 at the lower side 17 on an upper side 18 of the neck 6. At the lower side 17 of the suspension ring 15, a clamping ring 19 is provided, within the neck 6, in which a ring 20 which is attached to the upper side of the bracket 13 is clamped. In another embodiment, the bracket 13 may be formed integrally with the suspension ring 15 or be fixed thereto in a different manner, for instance by welding, gluing, snap-fitting, screws or otherwise.

The suspension ring 15 is provided with a central opening 21, around which, at the upper side of the ring 15, an edge 22 extends. As is clearly visible in FIG. 2, a valve 23, in particular an aerosol valve type valve 23, is arranged, as is also used in, for instance, a Tapvat™ keg of Heineken, Netherlands, and as described, for instance, in EP 99960036.4. If $CO_2$ or other propellant is to be introduced from an outer side into the inner space 8 of the container 2, then, to that end, in addition to the valve, for instance a second valve such as a second aerosol type valve, a one-way valve or an open inlet may be provided. Then also a double-acting valve, such as an aerosol valve, may be used as described in WO2008/048098, which specification is understood to be incorporated herein at least as regards the valves and the pressure regulator.

In the embodiment shown, the valve 23 is provided with a sleeve 24 in which a spring 25 is supported. The spring 25 presses a valve body 26 against a valve seat 27, for instance a plastic or rubber ring. When the valve body 26 is pushed down, off the seat 27, beverage can pass the valve body 26 and be dispensed. Attached to the sleeve 24 at the lower side is a riser 28, which extends to a point near the bottom 7. The sleeve 24, which may for instance be made of metal, is fixed in a clinch plate 29. The clinch plate 29 is fixed by an outer edge 30 thereof over the edge 22. The outer edge 30 may for instance be clinched over the edge 22. Surprisingly, this has been found to be very well possible when the clinch plate 29 is manufactured from metal such as steel or aluminum and the ring 15 from plastic.

Figure 5:
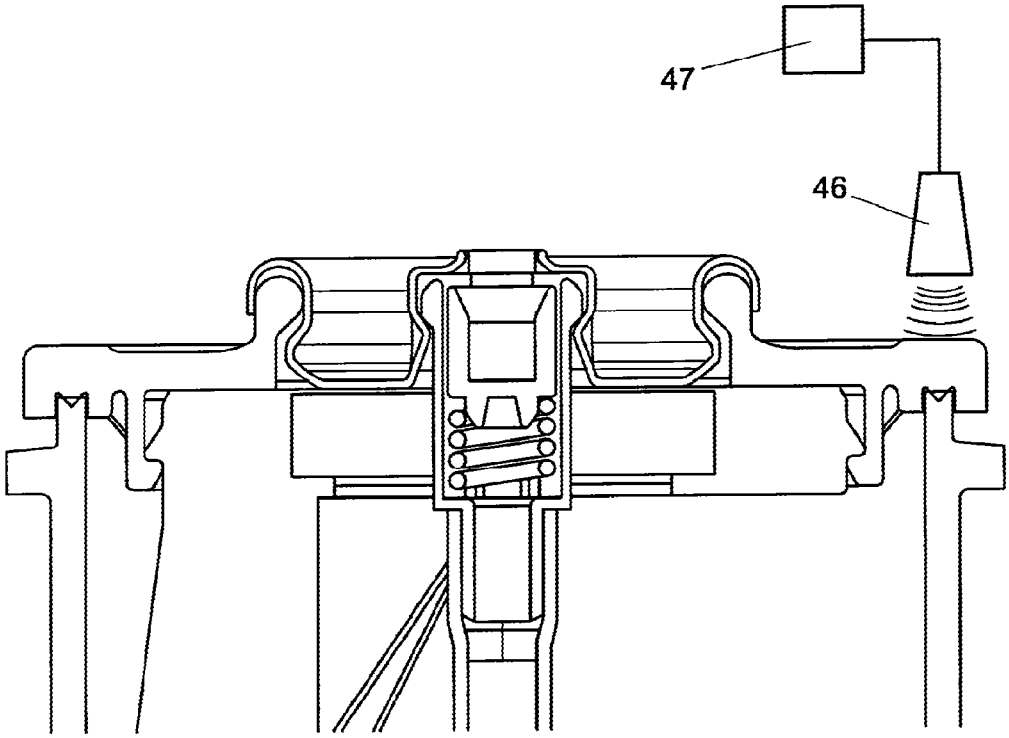
FIG. 5 schematically shows a portion of a holder according to the invention, with a pressure device being fixed onto the holder with the aid of a welding device, in particular an ultrasonic welding device.

The suspension ring 15 is provided, at the lower side 17, with a groove 31 which can be slid over the upper side 18 of the neck 6 with a relatively close fit. Within the groove 31, an edge 32 may be provided, for instance an edge 32 having a slightly pointed cross section, for instance substantially triangular or parabolic. As a result, the suspension ring 15, when laid onto the upper side 18 of the neck, will be supported on the edge 31, so that a relatively small contact surface is obtained. The edge 32 preferably has a height that is smaller than the depth of the groove 31, so that in that position the groove 31 has respective longitudinal edges 33 abutting against the inside and outside of the neck 6, which is thereby properly positioned. In this condition, the suspension ring 15 can be fixed onto the neck 6. To that end, preferably, use is made of a welding technique, such that a part of the material of the neck 6 and/or the suspension ring 15, including the edge 32, if present, melts at least partly. As a result, a good contact surface is obtained and upon cooling of the material a firm connection between the neck and the suspension ring 15 will be obtained. In an advantageous embodiment, use is made of ultrasonic welding technique, as schematically represented in FIG. 5, in which schematically a horn (loudspeaker) 46 of an ultrasonic welder 47 is directed at the suspension ring 15 and neck 6. An advantage of use of welding technique, in particular ultrasonic welding technique, is that it will yield particularly good connections, also when for instance parts of the ring 15 and/or the neck 6 are moist, for instance as a result of filling of the container 2 with beverage. As a consequence, the connection can also be obtained after the holder has been filled. The connection is preferably not reversible. This means that a user cannot open the holder, for instance, by separating the suspension ring 15 from the neck. In this way, the chance of contamination or any other tampering with the beverage is prevented. The suspension ring 15 in this embodiment forms a valve. The suspension ring can have a central area around the opening 21 that is thinner than the edge 16. The central area can form a closing surface, with the edge possibly standing up from the central area.

In the embodiment shown in FIGS. 1 and 2, the suspension bracket 13 is so designed that the pressure device 9 is suspended in a position offset with respect to a centerline H of the neck 6 and, in the embodiment shown, the longitudinal axis or centerline $H_1$ of the holder 1. To this end, the clamping ring 14 is mounted eccentrically to the bracket 13. The pressure device 9 may for instance be suspended such that a filling pipe 34 (shown in broken lines in FIG. 2) of a filling installation (not shown) can be inserted through the opening 21, parallel to the longitudinal axis Hi of the neck 6 and/or holder 1, without the pressure device 9 being touched thereby. This provides the advantage that the pressure device 9 can also be placed prior to filling of the holder 1, without the filling device needing to be adapted. A filling pipe 34 can be inserted in the holder 1 to a point near the bottom 7. After filling, the valve 23 can then be arranged and fixed, for instance by clinching or otherwise. The neck 6 preferably has a circular cross section with a radius of more than 13 mm or a passage area with a cross-sectional surface of more than 530 $mm^2$. The radius can for instance be between about 13 and about 20 mm, preferably between about 13 mm and 16 mm, or the surface may be of comparable proportions. In this way, the pressure device 9 with sufficient volume can be simply introduced through the neck 6 while the container 10 thereof may be cylindrical. Owing to the welding technique, in particular ultrasonic welding, no screw cap needs to be used.

In the embodiment shown in FIGS. 1 and 2, between the bracket 13 and the suspension ring 15, at least one rising surface 36 is provided, having an inclining edge 37. Viewed in side elevation, a rising surface 36 for instance extends from approximately near the longitudinal axis H of the neck adjacent the suspension ring 15 to the suspension bracket 13 approximately adjacent a middle of the bracket 13, viewed in the height direction of the holder 1. The or each rising surface 36 is preferably so arranged that if the pressure device 9 is inserted through the neck 6 and, for instance, released, the pressure device 9 is forced into the inner space 8 under the influence of gravity and at the same time is pushed to the side by the rising surfaces 36 until the suspension ring 15 butts against the neck 6. In this way, the pressure device 9 is particularly simply and substantially automatically brought into the correct position.

In the embodiments shown, the suspension ring 15 is supported on the upper side of the neck 6. An advantage of such a construction may be that the pressure device can be brought to its position by gravity and will not fall farther into the container. Moreover, this can simplify welding. However, naturally also other configurations can be used, so long as the suspension means and the neck 6 are mutually weldable.

In FIG. 2 there is schematically shown a dispensing tube 40 which via an operating button 41 with a channel part 42 is inserted in the valve 23, in particular in the valve body 26. When the operating button 41 is pressed down, the valve 23 is opened and beverage can be dispensed from the inner space 8, via the dispensing tube 40.

Figure 4:
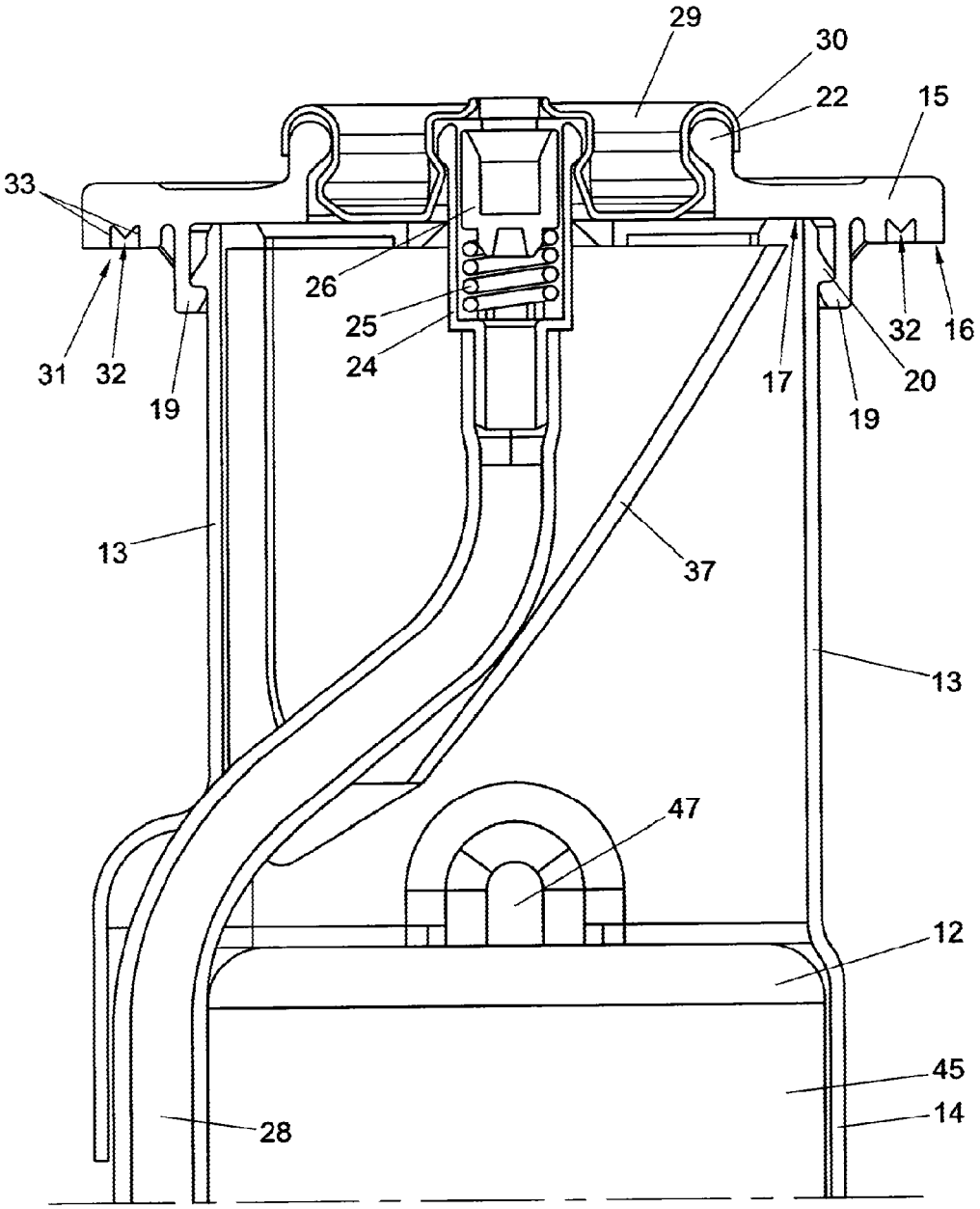
FIG. 4 shows in magnification a portion of a holder according to FIG. 3.

In FIGS. 3 and 4 an alternative embodiment is shown of a part of a holder 1 according to the invention. In broad outline, it is equal to the holder according to FIGS. 1 and 2, however, the pressure device 9 is suspended straight under the neck 6. Again, the suspension ring 15 is fixed onto the neck 6, in particular by welding technique, more particularly by ultrasonic welding. The bracket 13 in this embodiment is substantially tubular, with an inclined surface 37 being arranged, such that when a riser 28 is inserted through the opening 21, it is pushed aside and bent, such that it is simply forced alongside the pressure device 9 and at least alongside the container 10. An opening 38 may be provided near a lower side of the surface 37, to which a tube 39 is connected which guides the riser in the right direction. The container may be filled prior to placement of the pressure device but may also be filled through the opening 21. Openings 47 are provided, through which the beverage such as beer can flow, via the tubular bracket 13, into the inner space 8.

In an embodiment, the holder 2 or at least the neck 6 thereof may be manufactured from a weldable, in particular an ultrasonically weldable plastic, such as for instance PET, PEN, PE, PP or the like, which plastic is moreover preferably recyclable. It is preferred to use a plastic allowing the container 2 to be blown from it, in particular with a relatively thick wall thickness, being for instance, though no limited to, thicknesses between a few tenths of millimeters and a few millimeters, in order to obtain a container 2 which is pressure-resistant at the earlier-mentioned pressures or higher. The suspension ring 15 may be manufactured from a plastic compatible therewith. Compatible should herein be understood to refer to a plastic that is weldable, in particular ultrasonically weldable, with the plastic of the neck 6. In an embodiment, the container 2 and the suspension ring 15 are manufactured from PET or a blend thereof. The bracket 13 may be manufactured from a different plastic or the same plastic. The whole suspension of the pressure device in the container 2 may also be manufactured, for instance, by 2K, or more K, injection molding. These examples merely serve for illustration and should not be construed in any way as limiting.

In an advantageous embodiment, the suspension ring 15 is at least partly translucent, in particular in that part where the suspension ring 15 is connected with the container 2. In this way, the weld between the suspension ring 15 and the container 2, in particular the neck 6, can be simply checked, in particular optically, for instance by visual inspection. Such an inspection can be carried out with the naked eye but can also be carried out, for instance, by a camera such as a CCD camera and image recognition software. Also, other systems known per se from practice may be used to check such welds (semi)automatically. Herein, translucent should be understood to mean at the least, though not exclusively so, transmissive of a light frequency suitable for checking the joint mentioned.

In the description an example has been given of a configuration of the cooperating edge of the suspension ring and the neck of the container, in particular an upper side thereof. Many variations thereon are possible, as for instance known from publications of the firm of Sonitek—Sonic & Thermal Technologies, Inc, Milford. These and comparable configurations can be used in a holder 1 according to the invention. A choice from the possible configurations can be readily made by one skilled in the art, depending on the specifications chosen. In an exemplary embodiment, the suspension ring 15 at the edge 17 had a thickness of 3.0 mm, the edge 32 having an approximately triangular cross section of a height of 0.6 mm. The suspension ring 15 and neck 6 were manufactured from PET. The suspension ring 15 was welded to the neck 6 using an ultrasonic welder type USP-3000/5KW with Sonotrode TE20 104B2/1 of the firm Telsonic, with a setting of Welding pressure 2.9 bar; Powermax 5562 W; Energy 300Ws; holdtime 0.5 sec; Sonictime 110 ms. Naturally, also other ultrasonic welding devices can be used and the setting will depend inter alis on the materials used and the geometry used.

Figure 6:
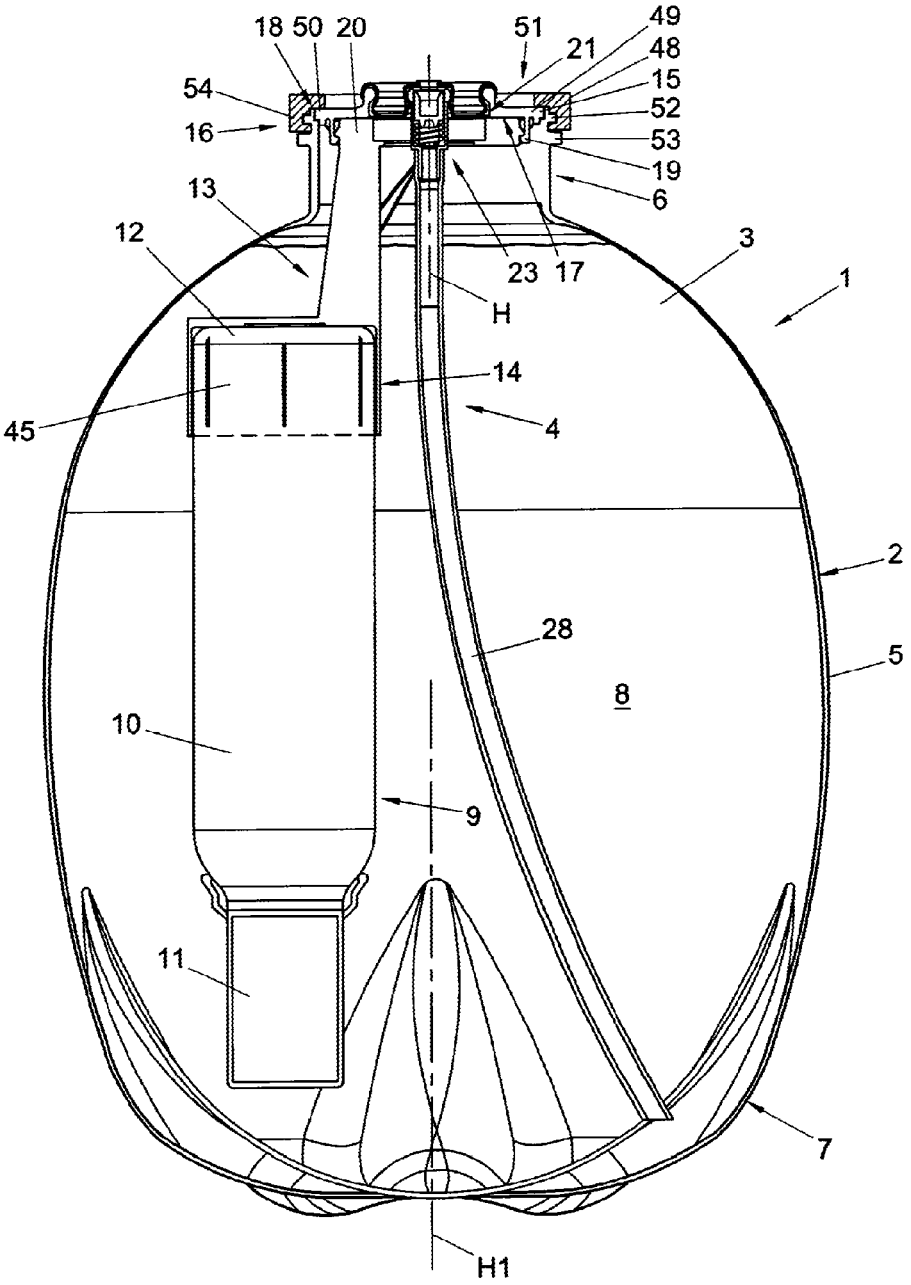
FIG. 6 shows a holder similar to FIG. 1, with alternative fastening.

In FIG. 6 an embodiment of a holder 1 is shown, similar to that according to FIG. 1, where, however, the bracket 13 is locked in the neck 6 and the inner space 8 by means of a retaining ring 48 clamped onto the neck over the suspension ring 15. In this embodiment, the neck 6 is provided on the inside with a shoulder 49 on which the retaining ring 15 rests. Around the shoulder 49 extends an upstanding edge 50 which has a height approximately equal to the thickness of the suspension ring 15. In this way, the suspension ring 15 is locked between the retaining ring 48 and the shoulder 49. The retaining ring 48 has a central opening 51 through which a part of the dispensing device 4 can extend. The neck 6 is provided on the outside with two stiffening edges 52, 53. With these, the dimensional stability of the neck is enhanced. The retaining ring 48 has a circumferential groove 54 which fits over the upper one of the two stiffening edges 52, so that a firm connection is obtained and the bracket 13 is properly locked in the container 2. Although this connection can also be welded, it provides the advantage that this is not requisite.

Consequently, any desired combination of plastics and/or other materials can be used.

The bracket 13 and/or the suspension ring 15 may also be connected with the container 2 and/or each other by gluing or fusion.

Figure 7:
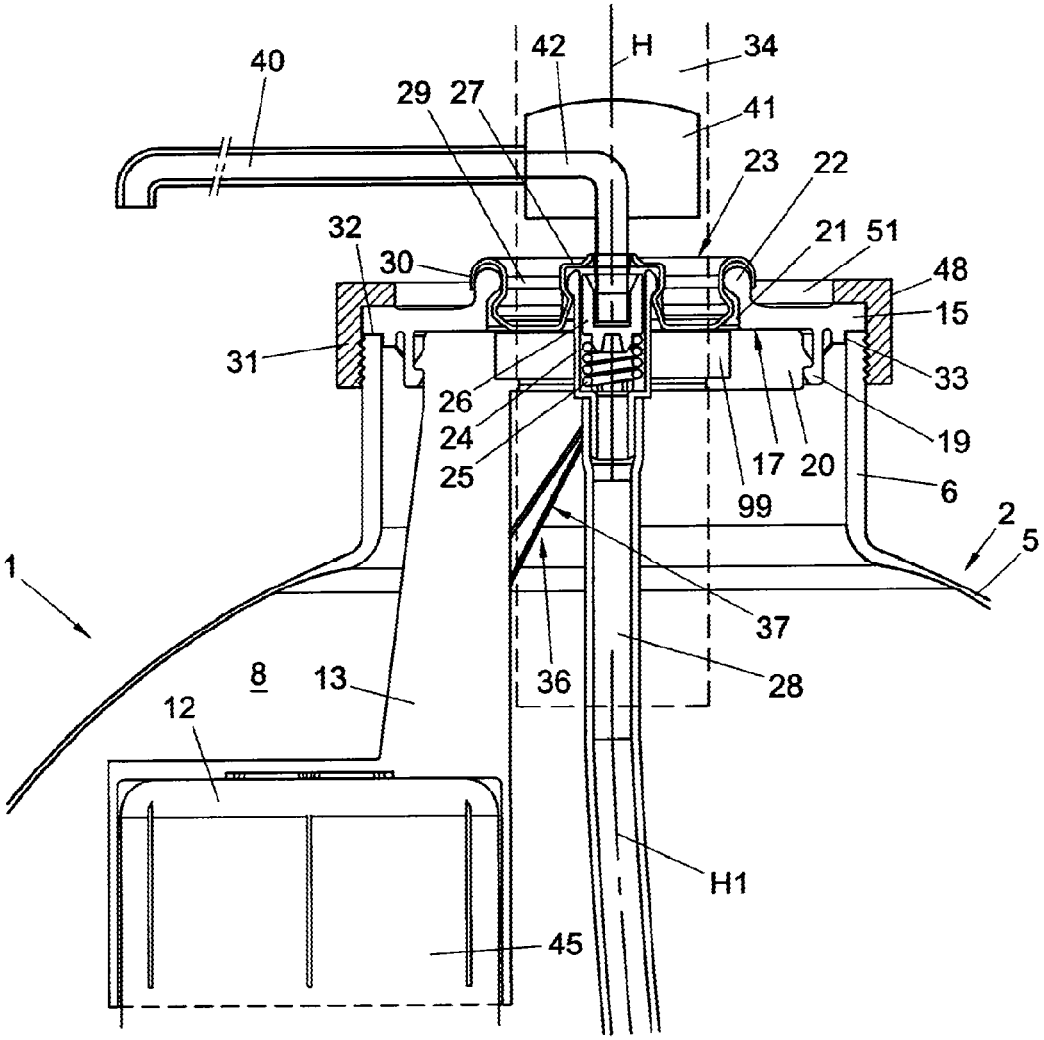
FIG. 7 shows a portion of a holder, similarly to FIG. 2, with a further alternative fastening.

FIG. 7 shows a part of a holder similar to that according to FIG. 2, where the retaining ring 48 is screwed over the neck 6 and the suspension ring 15. The suspension ring 15 then rests, in the manner described earlier, on the upper side of the neck 6 and is clamped against it by the retaining ring 48.

Figure 8:
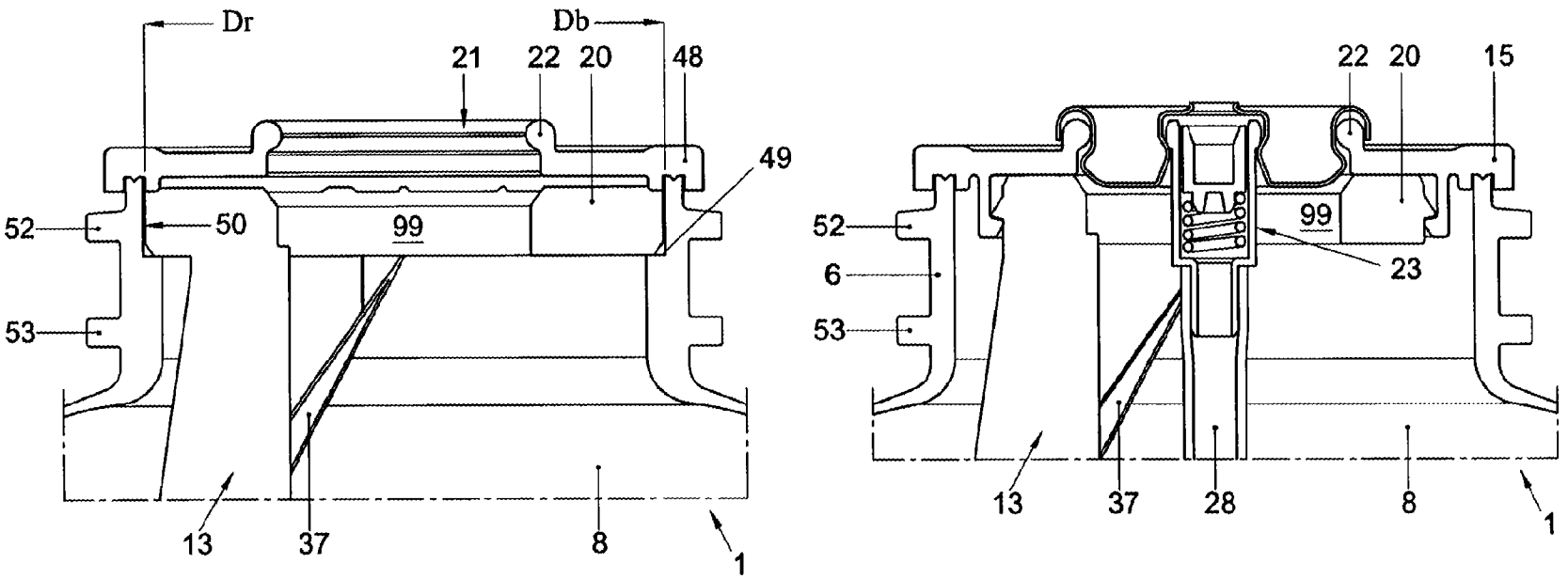
FIG. 8 shows next to each other a fastening according to FIG. 1 and a fastening in an alternative embodiment.

FIG. 8 shows next to each other, partly sectioned, a portion of a holder 1 according to FIGS. 1 and 2 (left) and according to an alternative embodiment, with the valve 23 and riser 28 omitted. The suspension bracket 13 is suspended with a ring 20 on a shoulder 49, similarly to FIG. 6. A retaining ring 48, here of similar design to the suspension ring 15 according to FIG. 1 but without the edge 19, is placed over the ring 20 onto the neck 6 and connected thereto by a joining technique, such as welding or gluing. The ring 20 can have an outer diameter $D_r$ which is slightly greater than the inner diameter Db of the neck 6 above the shoulder 48, so that the ring 20 is slightly clamped in radial sense. In this way, the bracket 13 can be held in place better during fastening of the retaining ring 48, without the retaining ring 48 needing to be pressed-on to that end. The valve may be fixed to the edge 22, for instance clamped or clinched.

Figure 9:
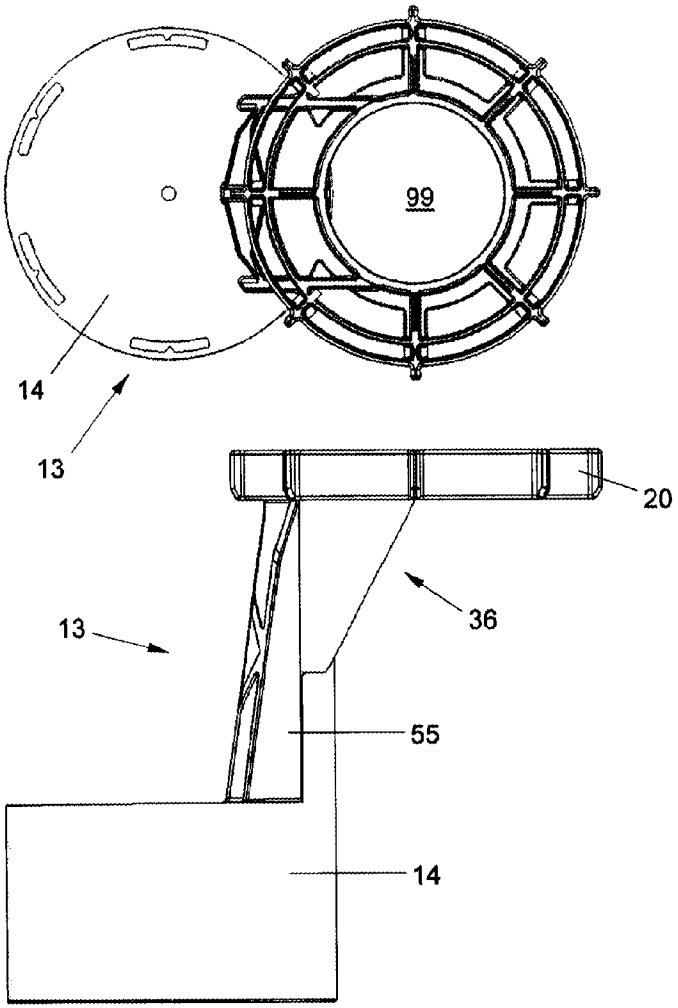
FIG. 9 shows a first alternative bracket.
Figure 9:
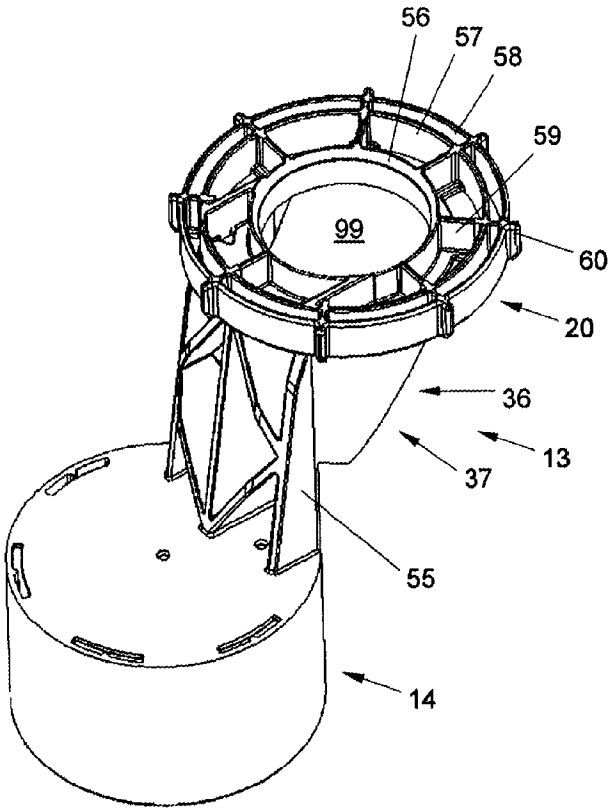

FIG. 9 shows in perspective view, in top plan view and in side elevation, a suspension bracket 13. The suspension bracket 13 is preferably manufactured from plastic and comprises the clamping ring 14 and the ring 20 with passage opening 99, mutually connected by a connecting part 55. The connecting part 55 is provided with two rising surfaces 36 which additionally serve as stiffening elements between ring 20 and connecting part 55. The ring 20 is provided with an inner ring 56, a central ring 57, and an outer ring 58, mutually connected by spokes 59 which extend for instance from the inner ring 56 as far as or just beyond the outer ring 58, for instance in radial direction. On the outer ring 58, protrusions are formed, for instance partly by the spokes 59, which can engage against the inside of the edge 50 above the shoulder 49 or against the retaining ring 48. They are preferably so dimensioned as to be slightly deformable in order to clamp the ring 20 within the edge 50 or the retaining ring. In this way, movement, for instance rattling, rocking or turning of the bracket can be prevented, at least prior to placement and/or fastening of the retaining ring 48. At least the inner ring 56 is open, so that a part of the dispensing device 4 can extend through it.

Figure 10:
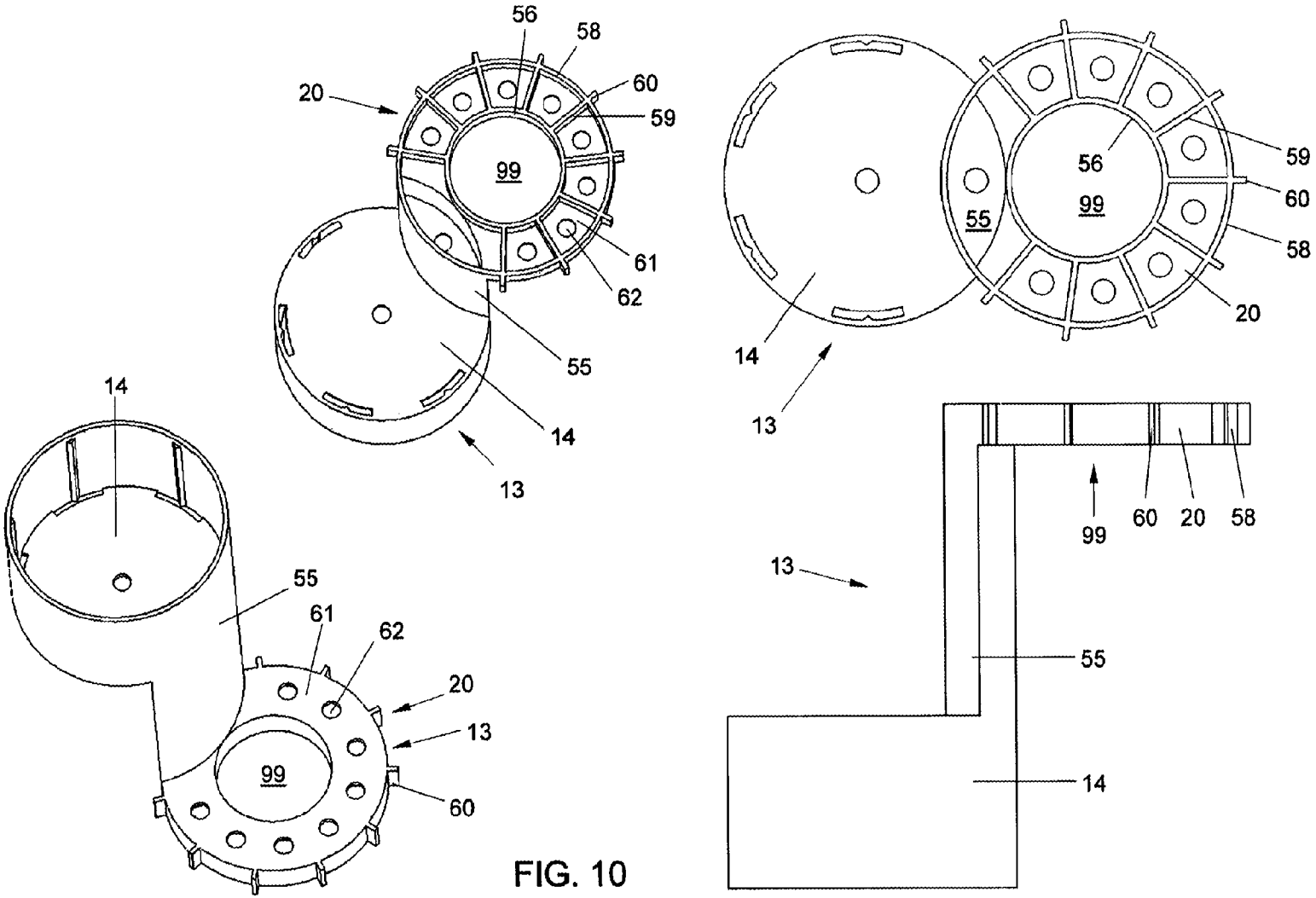
FIG. 10 shows a second alternative bracket.

FIG. 10 shows an alternative embodiment of a bracket 13, in perspective top plan and bottom view, in top plan view and a side elevational view. In this embodiment, again a clamping ring 14 is provided, for holding, for instance, a pressure regulator, and connected with a ring 20 by a connecting element 55. In this embodiment, the ring 20 comprises two concentric rings 56, 58, mutually connected by spokes 59 and a surface 61. In the surface, between the spokes, openings 62 are provided. The inner ring 56 is again open. The connecting part 55 in this embodiment is slightly tubular and substantially straight, so that the bracket 13 can be manufactured with a simple open-close mold, because the bracket is withdrawable. The ring 20, viewed in bottom and top plan view, then extends slightly above and under the clamping ring 14, respectively, with the connecting part 55 having a shape equal to the virtual plane of intersection of the two rings 14, 20. Again, protrusions 60 may be provided for fitting and/or clamping the ring 20 in or on the neck, under or in the retaining ring 48.

Figure 11:
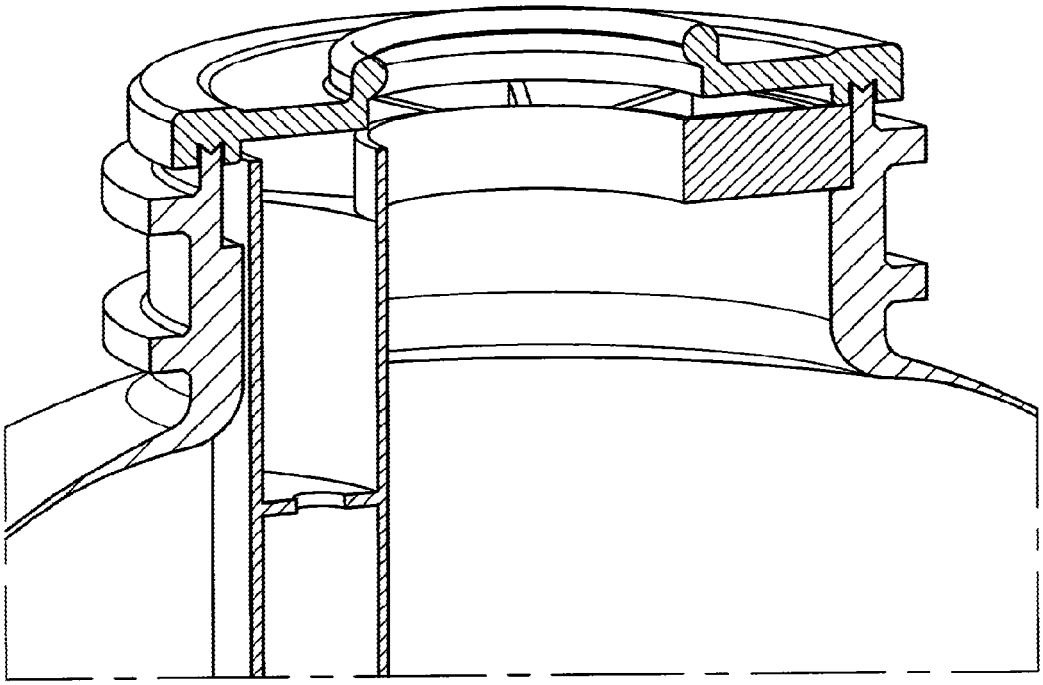
FIG. 11 shows a portion of a holder, shown in perspective view in FIG. 11A, with a portion of an alternative bracket according to FIG. 10.

In FIG. 11A, a container 2 is shown, having a bracket 13 suspended therein, the bracket 13 being designed as shown in FIG. 10. Clearly visible is the abutment of the protrusions 60 against the inside of the neck 6, in particular against the edge 50 above the shoulder 49. In FIG. 11A the retaining ring 48 is shown, placed over the ring 20, which retaining ring 48 is omitted in FIG. 11.

Figure 12:
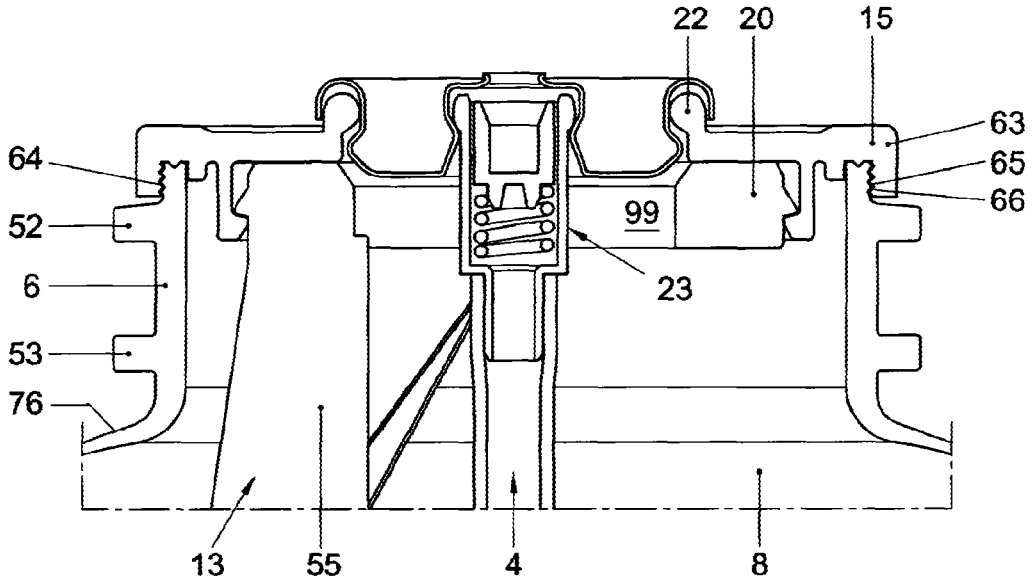
FIGS. 12 and 13 show further alternative embodiments of a fastening of an internal element suspended or supported in a neck of the holder.

FIG. 12 shows an alternative suspension of a bracket 13 with the aid of a retaining ring 15, similar to that according to FIGS. 1 and 2, where, however, an outer edge 63 of the retaining ring 15 is provided with a downwardly extending edge 64 which is provided with internal thread 65 which can cooperate with outside thread 66 on the neck 6. Naturally, this can also be a different connection known per se, for instance a bayonet connection. If desired, the connection between the retaining ring 15 and the neck 6 may be so designed that it can only be tightened and cannot be loosened, for instance by using one-way thread or a ratchet connection.

Figure 13:
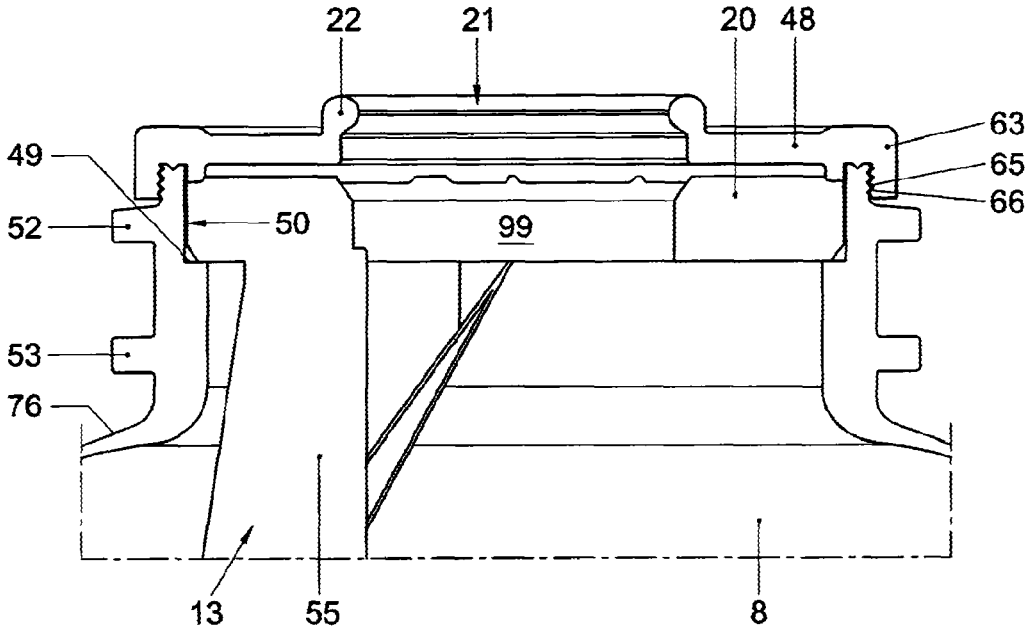

In FIG. 13, a connection similar to FIG. 12 is shown, where, however, the ring 20 of the bracket 13 is laid on a shoulder 49 and the retaining ring 48 is screwed on the neck 6, thereby locking the ring 20 and hence the bracket 13.

FIG. 14 shows in partly phantom view a holder 1 with a support or stand ring 67 provided to the bottom 7 of the container 2. This support or stand ring can provide the advantage, among others, that the bottom 7 of the container can be convex. Another advantage may be that the holder can stand better, in particular more stably, and can be rendered stackable. Moreover, the ring 67 can provide protection for the container. The ring is preferably manufactured from plastic.

Figure 15:
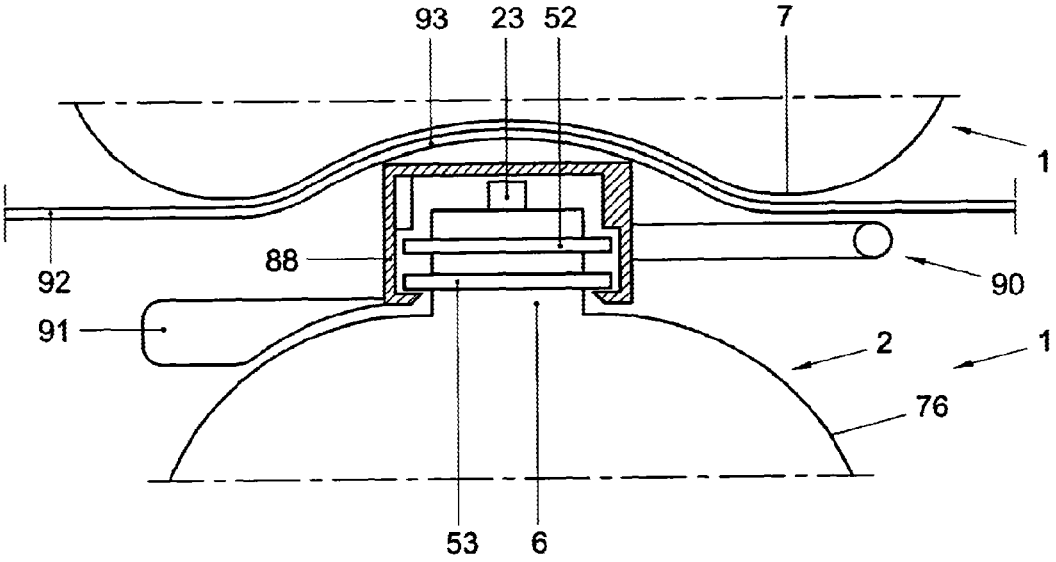
FIG. 15 shows parts of two holders stacked above each other.

In FIG. 15, there is schematically shown how two holders 1 can be stacked. A lower holder 1 is provided with a cap 88 over the neck 6, for instance clamped under the lower edge 53 with the aid of snap fingers 89. The cap 88 covers the valve 23 and thereby provides that it is protected and moreover screened from unintended use. The cap 88 can thus have a tamper evidence function. On the cap 88 a grip 90 may be provided, for instance bendable from a storage position as shown in FIG. 15 to a carrying position in which the grip extends upwards in a direction away from the holder 1, so that the holder 1 can be carried by the grip. Also, on the cap or around the neck a bag, blister or other packaging 91 may be provided, in which for instance tapping parts 40, 41, 42 may be packaged and supplied along with the holder 1. An intermediate sheet 92, for instance manufactured from paper, cardboard or plastic, may be laid on a number of holders 1 placed next to each other. The intermediate sheet may be provided with deformations 93 or openings which can be positioned on or around the caps 88 of the holders. A next holder or layers of holders 1 can then be placed on the intermediate sheet 92, over the deformations 93 or openings, above the subjacent holders 1. Many variants thereon are possible, which will be immediately clear to those skilled in the art.

Figure 16:
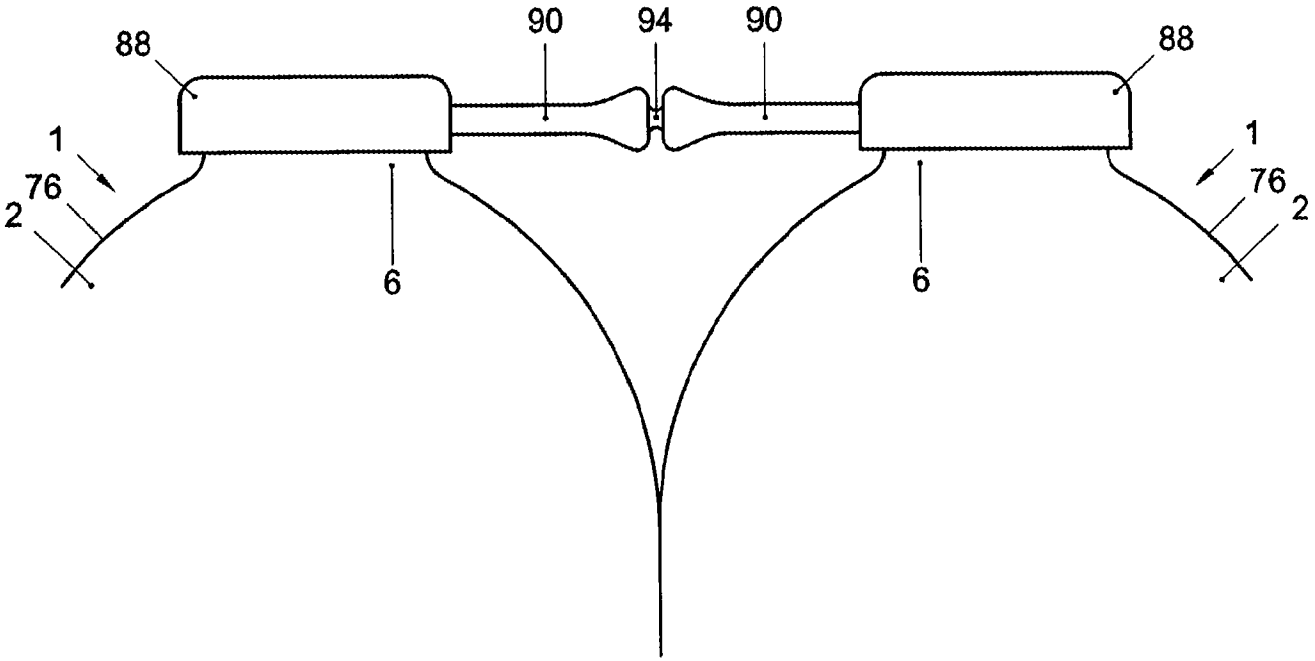
FIG. 16 shows in side elevation two mutually coupled holders.
Figure 17:
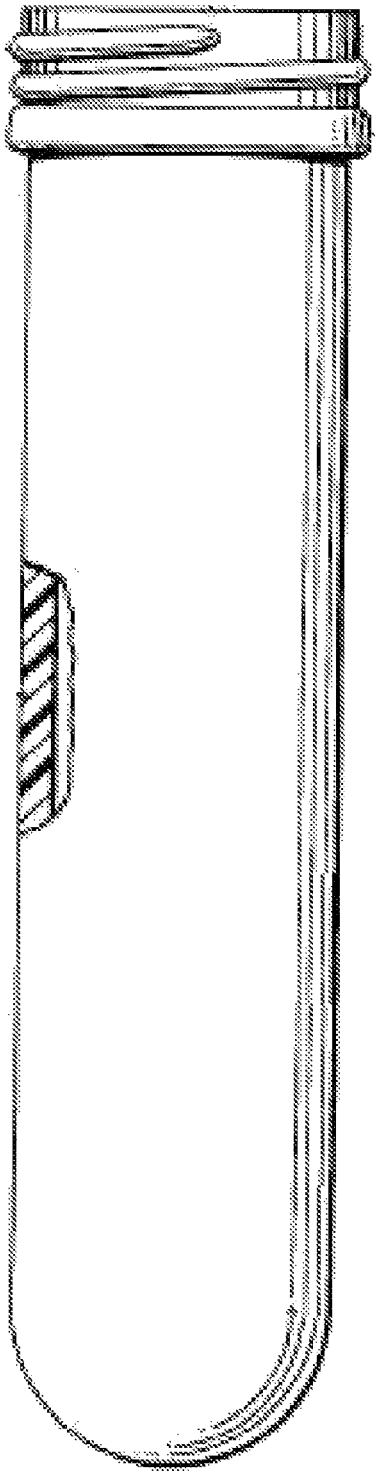
FIG. 17 illustrates a preform.

In FIG. 16, schematically, a side elevation is shown of two holders 1 mutually coupled by the grips 90. The grips 90 in this embodiment may be formed jointly, for instance by injection molding, being mutually connected by breaking parts 94, for instance relatively thin bridges. The coupled grips 90 can provide stability to the holders during storage and transport, while they can provide the possibility of picking up two holders jointly and transporting them by machine or by hand. A hand can embrace the two coupled grips, for lifting the holders 1. Moreover, the grips can provide stability when the holders 1 are stacked. Especially when the holders are stacked in interlocking patterns.

The invention is not in any way limited to the embodiments as represented in the description and drawings. Many variants thereon are possible within the framework of the invention outlined by the claims. Variants include all combinations of parts of the embodiments shown. For instance, the container may be wholly or partly formed differently, a different mass or other beverage may be packaged and moreover the holder and the pressure device can have any desired shape and dimensions. Also, the pressure regulating device may be arranged on an outside of the container or between the container and an inner container arranged therein.

The invention claimed is:

1. A holder for beverage, comprising a container manufactured substantially from plastic, provided with a neck, wherein in an inner space of the container liquid is provided and on or in the neck a valve is provided, through the valve extends a dispensing means, wherein the valve is fixed in or to the neck, wherein in or on the neck an element is suspended which at least partly extends in the inner space of the container and at least partly surrounds the dispensing means, wherein the holder is provided with a pressure device for pressurizing the liquid in the container, wherein the pressure device is included in the container entirely and the container is closed non-reversibly by at least a closure, such that a user cannot open the container.

2. A holder according to claim 1, wherein the container comprises a shoulder in the neck, on which the element rests at least partly.

3. A holder according to claim 1, wherein the valve is fixed to the neck by welding.

4. A holder according to claim 1, wherein the valve is fixed onto an upper edge of the neck.

5. A holder according to claim 1, wherein the container is a blown plastic bottle.

6. A holder according to claim 1, wherein the pressure device is included in the container and is part of or suspended from the element, wherein the element is a bracket, having a first end connected to the neck and an opposite end carrying the pressurizing device, axially spaced apart from the valve.

7. A holder according to claim 6, wherein the pressure device comprises a pressure cartridge filled with gas, as well as a pressure regulating device with which the gas can be introduced into the container in a dosed manner.

8. A holder according to claim 1, wherein the liquid is carbonated beverage and the pressure regulating device is configured for regulating the pressure in the container at approximately the level of an equilibrium pressure of carbon dioxide in the beverage at a temperature between 0 and 15 degrees Centigrade.

9. A holder according to claim 1, wherein the pressure device in the container is suspended from the valve.

10. A holder according to claim 1, wherein the element is an inner container.

11. A holder according to claim 1, wherein the valve is or comprises a ring, which is attached in and/or on the neck, wherein the ring is provided with an opening with an edge on which a dispensing device is fastened.

12. A holder according to claim 1, wherein a pressure regulating device is suspended with aid of the element in the inner space of the container, displaced with respect to a longitudinal axis of the neck and/or container.

13. A holder according to claim 1, wherein a connection between the valve and the container is irreversible.

14. A container for a holder according to claim 1.

15. A preform or a set of preforms for blowing of a container for a holder according to claim 1.

16. A holder according to claim 6, wherein a riser pipe is connected to the valve and extends alongside the pressurizing device or passes between the valve and the pressurizing device.

17. A holder according to claim 1, wherein the container comprises a shoulder within the neck of the container, on which the element rests at least partly.

18. A holder according to claim 1, wherein the valve is or comprises a ring, which is attached in and/or on the neck, wherein the ring is provided with an opening with an edge on which a valve is fastened.

19. A holder according to claim 18, wherein the valve is fastened by clinching.

20. A holder for beverage, comprising a container manufactured substantially from plastic, provided with a neck, wherein in an inner space of the container liquid is provided and on or in the neck a valve is provided, through the valve extends a dispensing means, wherein the valve is fixed in or to the neck, wherein in or on the neck an element is suspended which at least partly extends in the inner space of the container and at least partly surrounds the dispensing means, wherein the holder is provided with a pressure device for pressurizing the liquid in the container, wherein the valve is or comprises a ring, which is attached in and/or on the neck, wherein the ring is provided with an opening with an edge on which a dispensing device is fastened, wherein in the container a pressure regulator device is provided, inserted through the neck, wherein the pressure regulator device is dimensioned such that the pressure regulator can not be introduced through the opening of the ring.

21. A holder for beverage, comprising a container manufactured substantially from plastic, provided with a neck, wherein in an inner space of the container liquid is provided and on or in the neck a valve is provided, through the valve extends a dispensing means, wherein the valve is fixed in or to the neck, wherein in or on the neck an element is suspended which at least partly extends in the inner space of the container and at least partly surrounds the dispensing means, wherein the holder is provided with a pressure device for pressurizing the liquid in the container, wherein the valve is or comprises a ring, which is attached in and/or on the neck, wherein the ring is provided with an opening with an edge on which a dispensing device is fastened, wherein the neck has a passage with a surface area of more than 530 $mm^2$, wherein the opening in the ring has such dimensions that a filling pipe of a filling device can be inserted through the ring into the container.

22. A holder for beverage, comprising a container manufactured substantially from plastic, provided with a neck, wherein in an inner space of the container liquid is provided and on or in the neck a valve is provided, through the valve extends a dispensing means, wherein the valve is fixed in or to the neck, wherein in or on the neck an element is suspended which at least partly extends in the inner space of the container and at least partly surrounds the dispensing means, wherein the holder is provided with a pressure device for pressurizing the liquid in the container, wherein the pressure device is included in the container entirely and the container is closed non-reversibly by at least a closure, such that a user cannot open the container, wherein the closure comprises an opening with a clinch edge, wherein the dispensing device comprises an aerosol valve, which with aid of a clinch plate is fixed onto the clinch edge.

23. A holder according to claim 22, wherein the clinch edge is of plastic.

24. A holder according to claim 22, wherein the clinch plate is of metal.

25. A method for formation of a holder, wherein, into a plastic container with a neck, liquid is introduced through the neck, wherein the neck is at least partly closed off by a valve, and wherein a dispensing device is inserted into an inner space of the container, wherein an element is suspended in the inner space of the container from or in the neck, precedent to the introduction of the liquid, wherein the element at least partly surrounds the dispensing device, such that the liquid can be dispensed from the container only through the dispensing device, wherein the dispensing device is placed after introduction of the liquid, wherein a pressure regulator is introduced into the container through the neck, suspended from said element.

26. A method according to claim 25, wherein the pressure regulator is suspended in and/or from the neck with aid of the valve.

27. The method according to claim 25, wherein the neck is at least partly closed off by a valve precedent to the introduction of the beverage.

28. A method according to claim 25, wherein the pressure regulator is suspended in and/or from the neck with aid of the valve and is fixed by welding of the valve to the neck.

29. A method according to claim 28, wherein the welding is ultrasonic welding.

30. A valve for closing off a neck of a container, wherein said valve comprises a flange for fitting on or to a neck of a container and is provided with a bracket for suspending therefrom within the container a pressure regulating device comprising a pressure regulator, wherein the bracket is formed such that a suspension element for the pressure regulator is provided at a distance of the flange, connected to the flange by at least a connection part through which or along which a riser of a dispensing device can be formed.

31. A valve according to claim 30, wherein the suspension element is displaced with respect to an axis of the flange.

32. A container comprising a valve according to claim 30.

33. The valve according to claim 31, wherein the suspension element is a ring.

* * * * *